US011820617B2

(12) United States Patent
Kato et al.

(10) Patent No.: US 11,820,617 B2
(45) Date of Patent: Nov. 21, 2023

(54) PRINTER

(71) Applicants: CITIZEN WATCH CO., LTD., Tokyo (JP); CITIZEN SYSTEMS JAPAN CO., LTD., Tokyo (JP)

(72) Inventors: Yukihisa Kato, Higashimurayama (JP); Takeo Komiyama, Higashikurume (JP); Kohei Daimon, Saitama (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 383 days.

(21) Appl. No.: 17/159,389

(22) Filed: Jan. 27, 2021

(65) Prior Publication Data

US 2021/0261375 A1 Aug. 26, 2021

(30) Foreign Application Priority Data

Feb. 25, 2020 (JP) ..... 2020-028973

(51) Int. Cl.
*B65H 29/70* (2006.01)
*B65H 29/12* (2006.01)
*B41J 11/00* (2006.01)

(52) U.S. Cl.
CPC ..... *B65H 29/70* (2013.01); *B41J 11/0005* (2013.01); *B65H 29/12* (2013.01)

(58) Field of Classification Search
CPC ..... B65H 29/70; B65H 29/12; B65H 23/34; B41J 11/0005
See application file for complete search history.

(56) References Cited

U.S. PATENT DOCUMENTS 1,807,274 A * 5/1931 Beidler ..... G03B 21/43 72/166
3,971,696 A * 7/1976 Manfredi ..... B65H 23/34 493/461
4,778,119 A * 10/1988 Yamazaki ..... B65H 18/10
9,701,135 B2 * 7/2017 Bae ..... B41J 11/04

FOREIGN PATENT DOCUMENTS

JP H05-000749 A 1/1993
JP 2012-192681 A 10/2012
JP 2018-104146 A 7/2018
JP 2000-086030 A 3/2020
JP 2000335798 A 12/2020

* cited by examiner

*Primary Examiner* — Thomas A Morrison
(74) *Attorney, Agent, or Firm* — Tucker Ellis LLP

(57) ABSTRACT

A printer includes a reverse bending member that bends a paper toward an opposite side to a curl of the paper, and a bifurcated member to correct the curl of the paper with the reverse bending member. The reverse bending member is disposed between a paper drawing position and a paper feeding roller. The bifurcated member is swingably arranged about a shaft extending in a width direction of the paper. The bifurcated member includes an upstream arm and a downstream arm. The upstream arm has a tip positioned between the rolled paper and the reverse bending member, and moves toward or from the reverse bending member. The downstream arm has a tip positioned between the reverse bending member and the feeding roller to be in contact with the paper, and rotates in accordance with a tension level of the paper to press the upstream arm toward the reverse bending member.

6 Claims, 10 Drawing Sheets

PRINTER

CROSS-REFERENCE TO RELATED APPLICATION

The present application is based on and claims a priority benefit of Japanese patent application No. 2020-028973, filed on Feb. 25, 2020, the disclosure of which is hereby incorporated herein by reference in its entirety.

BACKGROUND

This disclosure relates to a printer.

A printer which uses a rolled paper has been known. Since a rolled paper is wound or rolled into a roll, it is unavoidable to be curled. As a result, a paper printed by the printer using a rolled paper is ejected in a curled state. It is, however, not desirable for a user to have such a curled paper.

To that end, JP2000-335798A teaches a printer having a curl correction mechanism. In the printer of JP2000-335798A, the curl correction mechanism comprises a U-shaped arm disposed at a fixed part of a route for feeding paper and a pressing roller arranged between the U-shaped arm with play. A paper passes through a space between the U-shaped arm and the pressing roller in a zigzag pattern. By feeding the paper downstream for printing, the pressing roller is pulled downstream together with the paper by the force of pulling the paper (or the pressing roller is drawn downstream by the paper), resulting in contacting the U-shaped arm on the downstream side. Due to the contact of the pressing roller and the arm on the downstream side, the paper is pressed between the pressing roller and the arm, such that the curl of the paper is corrected.

SUMMARY

In the printer of JP2000-335798A, the curl correction mechanism is configured to move the pressing roller downstream in the paper feeding direction within the range of the play by utilizing the force for feeding the paper. With this curl correction mechanism, the paper is sufficiently pressed by the pressing roller only at the end point in the feeding route along the surface (peripheral surface) of the pressing roller. That is, the paper is hardly pressed by the pressing roller at the start point in the feeding range. Although it is possible to achieve some curl correction effect at the end point in the feeding route, it does not effectively correct the curl of the paper by using the entire feeding range along the peripheral surface of the pressing roller. When the diameter of the rolled paper decreases due to the consumption of the paper, the curl amount of the paper increases. Additionally, since the weight of the rolled paper also decreases due to the consumption of the paper, the rolled paper becomes easier to move when pulling and feeding the paper. As a result, it becomes difficult to maintain the pulling force applied to the paper at the start point in the feeding range along the peripheral surface of the pressing roller. Therefore, the effects for correcting the paper at the start point in the feeding range is reduced. Accordingly, it is difficult to achieve stable correction effects with the printer of JP2000-335798A.

The present disclosure is made in view of the above deficiency.

To achieve the above object, an embodiment of a printer described in the present disclosure comprises a reverse bending member that bends a paper drawn from a rolled paper toward an opposite side to a curl of the paper and a bifurcated member that collaborates with the reverse bending member to correct the curl of the paper. The reverse bending member is disposed between a drawing position at which the paper is drawn from the rolled paper and a position of a feeding roller for feeding the paper drawn from the rolled paper. The bifurcated member is swingably arranged about a swing center shaft extending in a width direction of the paper. The bifurcated member includes an upstream arm, a tip of which is positioned between the rolled paper and the reverse bending member, the upstream arm being configured to move toward or away from the reverse bending member, and a downstream arm, a tip of which is positioned between the reverse bending member and the feeding roller so as to be in contact with the paper, the downstream arm rotating in accordance with a tension level of the paper to press the upstream arm toward the reverse bending member.

DETAILED DESCRIPTION

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

Hereinafter, an embodiment of the present disclosure will be described with reference to the accompanied drawings.

Figure 1:
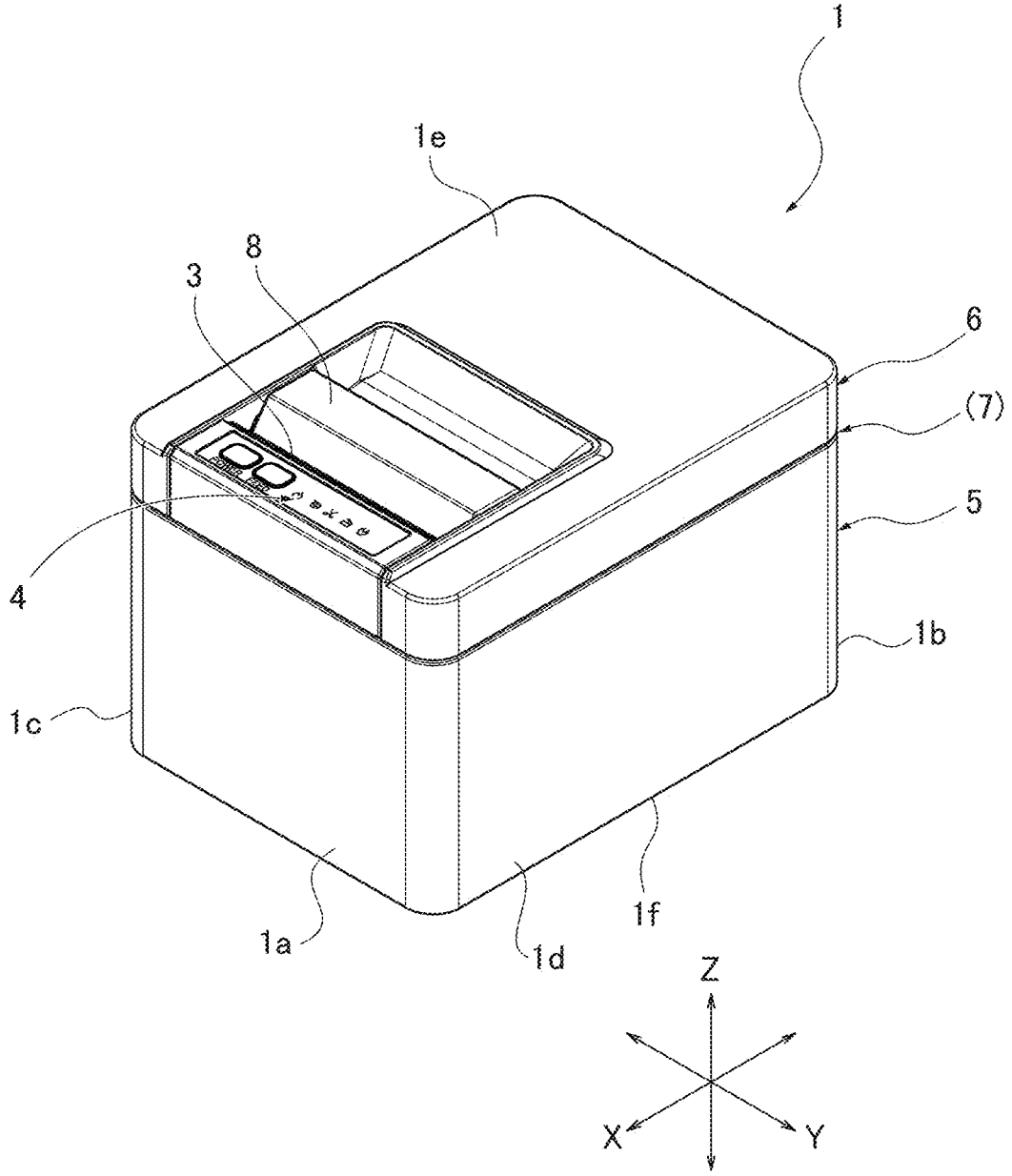
FIG. 1 is an overall perspective view of a printer according to the present disclosure.
Figure 2:
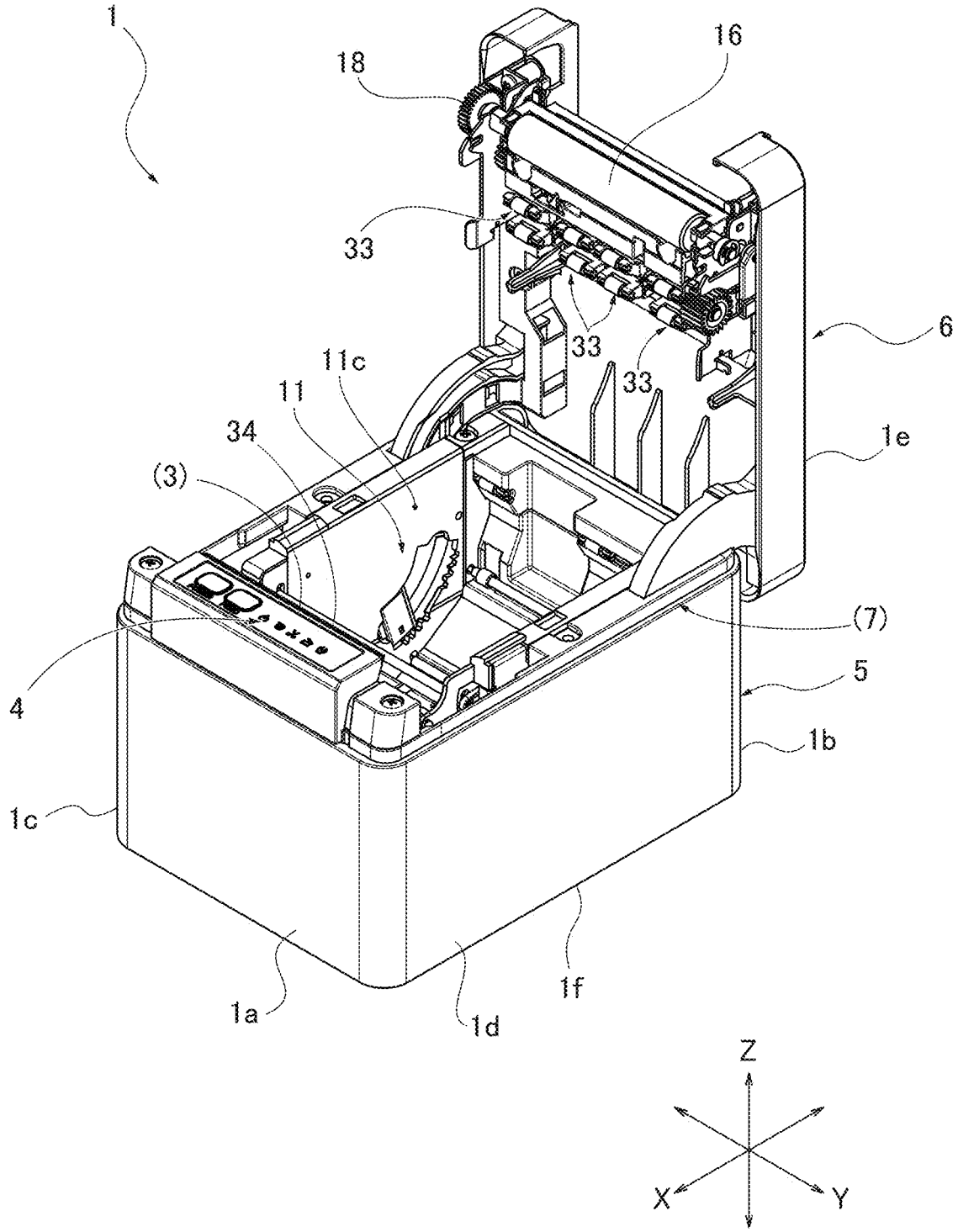
FIG. 2 is an overall perspective view of the printer of FIG. 1 when a cover of the printer is open.

FIGS. 1 and 2 show an overall perspective view of an image forming apparatus of a printing device such as a printer 1 according to this embodiment.

In this description, a horizontal direction passing through the front side and the rear side of the printer 1 with the printer 1 placed on a horizontal surface is defined as a front-back direction X. Similarly, a horizontal direction orthogonal to the front-back direction X is defined as a width direction Y, and a direction perpendicular to both the front-back direction X and the width direction Y is defined as a vertical direction Z.

The printer 1 has substantially a box shape, which includes a front surface 1*a* and a back surface 1*b* positioned on the front side and the back side in the front-back direction X, side surfaces 1*c*, 1*d* positioned on the left side and the right side in the width direction Y, and a top surface 1*e* and a bottom surface if positioned on the top side and bottom side in the vertical direction Z. However, the shape of the printer 1 is not limited to the box shape.

An ejection port 3 for a paper 2 is provided on the top surface 1*e* of the printer 1. On the top surface 1*e*, the ejection port 3 is positioned in the front side in the front-back direction X and at substantially the center in the width direction Y. An operation part 4 is provided in front of the ejection port 3. The operation part 4 includes an operation switch, an indicator lamp, and the like. Alternatively, the ejection port 3 may be provided on the front surface 1*a* of the printer 1.

As shown in FIG. 2, the box-shaped printer 1 includes a cover 6, which is attached over a printer body 5 so as to be openable and closable. The printer body 5 and the cover 6 are connected via a hinge part 7 on the side of the back surface 1*b* so as to be rotatable in the vertical direction Z and the front-back direction X. Accordingly, the cover 6 is opened upward and rearward with respect to the printer body 5.

With the printer 1, a paper 2 is set inside the printer body 5 by opening the cover 6 upward. On the top surface 1*e* of the cover 6, a lever 8 is provided for locking/unlocking the cover 6. In this embodiment, the lever 8 is positioned on the rear side of the ejection port 3.

Figure 3:
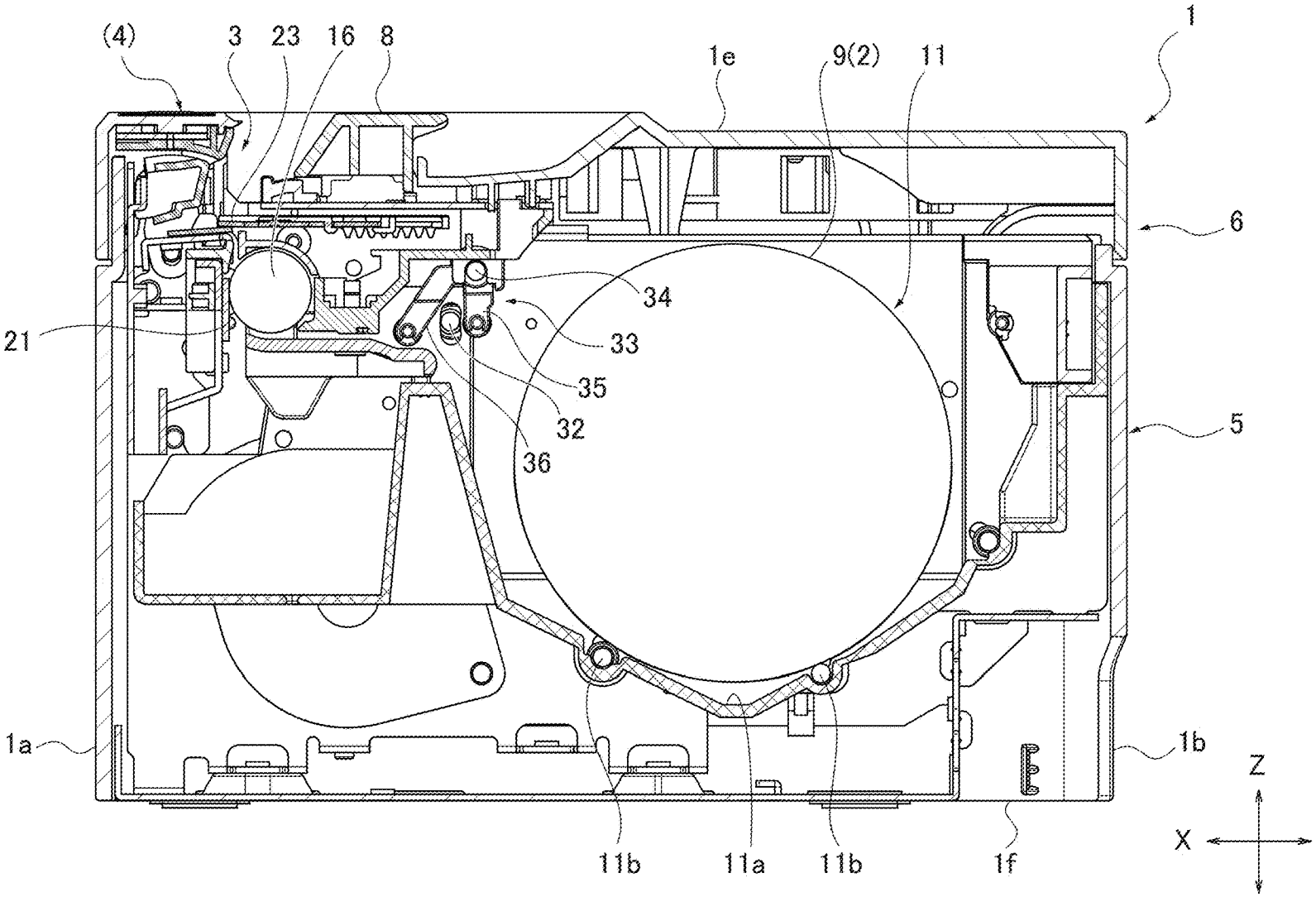
FIG. 3 is a cross-sectional view of the printer of FIG. 1.

As shown in FIG. 3, the paper 2 used for the printer 1 is a rolled paper 9, which is made by rolling a long paper into a roll. The rolled paper 9 is wound clockwise from the center toward the outer peripheral side. Here, the paper 2 and the rolled paper 9 refer to the same object, but for convenience, the portion pulled from the rolled paper 9 is referred to as the paper 2 and the portion in which the paper 2 is wound into a roll is referred to as the rolled paper 9.

The printer 1 of the embodiment is, for example, a thermal printer, a label printer that prints on a label, or other printers. When the printer 1 is configured as a thermal printer, a thermal transfer paper is used as the paper 2. The thermal transfer paper is wound to form a rolled paper 9 such that the outer peripheral surface thereof is used as the printing surface.

On the back side or rear side of the printer body 5, a tray 11 (paper tray) for loading the rolled paper 9 is provided. The tray 11 has a container shape with an open upper part. The rolled paper 9 is directly loaded into the tray 11 from the upper part. In this embodiment, the bottom face 11*a* of the tray 11 has a V shape when viewed from the width direction Y, and a plurality of bar-shaped supporting members 11*b* extending in the width direction Y is provided at the V-shaped portion of the bottom face 11*a*. The rolled paper 9 is supported from below by the supporting members 11*b* at several positions on the outer peripheral surface in a line contact state. With this, the rolled paper 9 can easily rotate in the feeding direction of the paper 2 in the tray 11. Alternatively, the rolled paper 9 may be rotatably supported in the tray 11 by a core rod passing through the center of the rolled paper 9.

Figure 4:
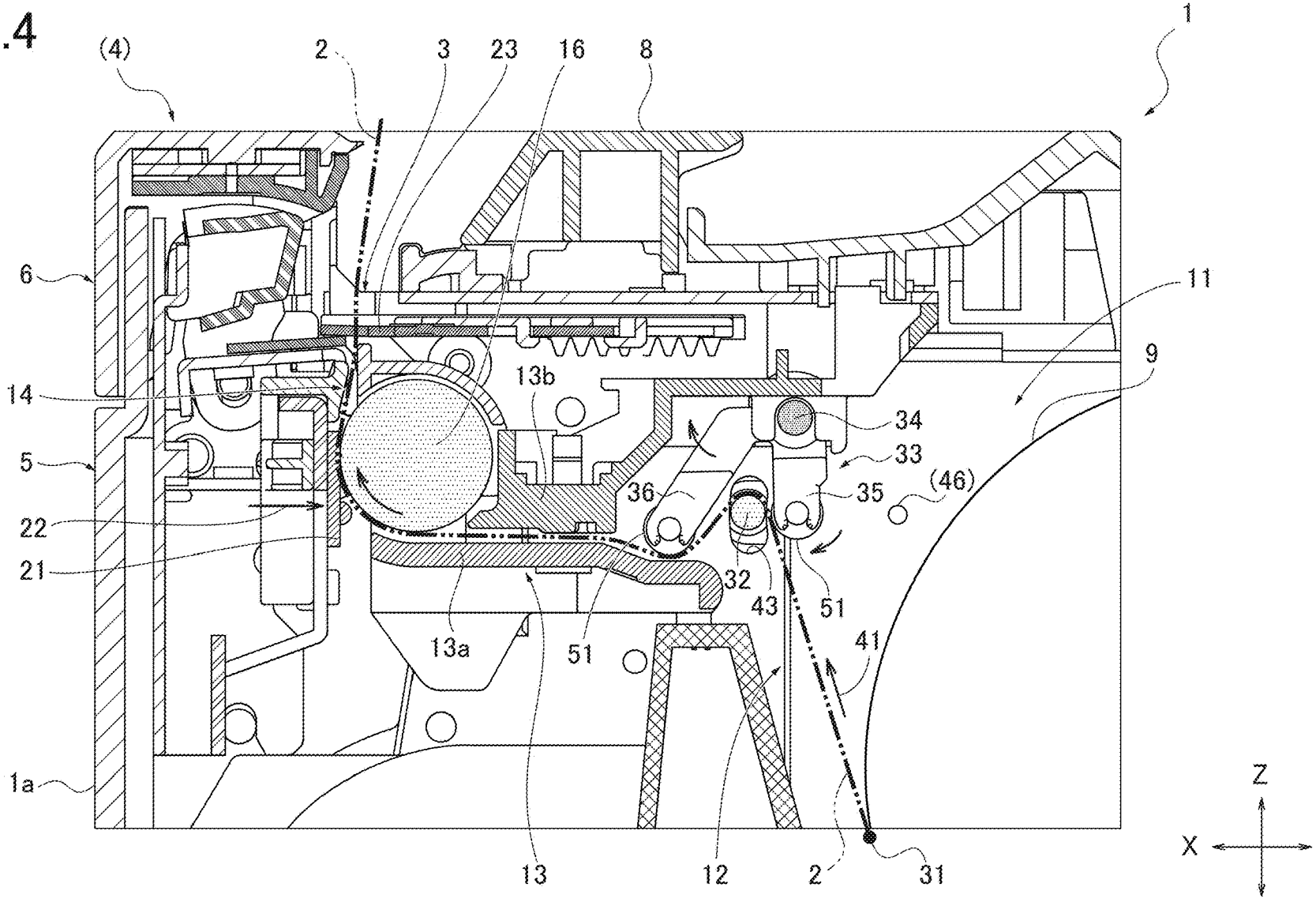
FIG. 4 is a partially enlarged view of FIG. 3.

The rolled paper 9 is loaded sideways in the tray 11 such that the axis direction of the rolled paper 9 is oriented in the width direction Y of the printer 1. Accordingly, the width direction of the paper 2 matches the width direction Y of the printer 1 (Hereinafter, it may also be referred to as the width direction Y of the paper 2). The tray 11 is capable of loading multiple types of rolled papers 9 having different width dimensions. In this embodiment, the paper 2 is pulled out or drawn out from the lower part of the rolled paper 9 to the front side, as shown in FIG. 4.

The paper 2 is pulled out from the front side of the lower part of the rolled paper 9 and fed to transfer routes 12-14 (paper feeding routes). The paper 2 is then guided to the ejection port 3 provided on the top surface 1*e* of the printer 1 so as to be ejected outside the printer 1 from the ejection port 3. As described later, the transfer routes 12-14 are roughly categorized into an upstream side, a middle flow side, and a downstream side depending on changes in the transfer direction of the paper 2. The middle transfer route 13 is formed between a lower route forming member 13*a* provided on the printer body 5 and an upper route forming member 13*b* provided on the cover 6.

Figure 11:
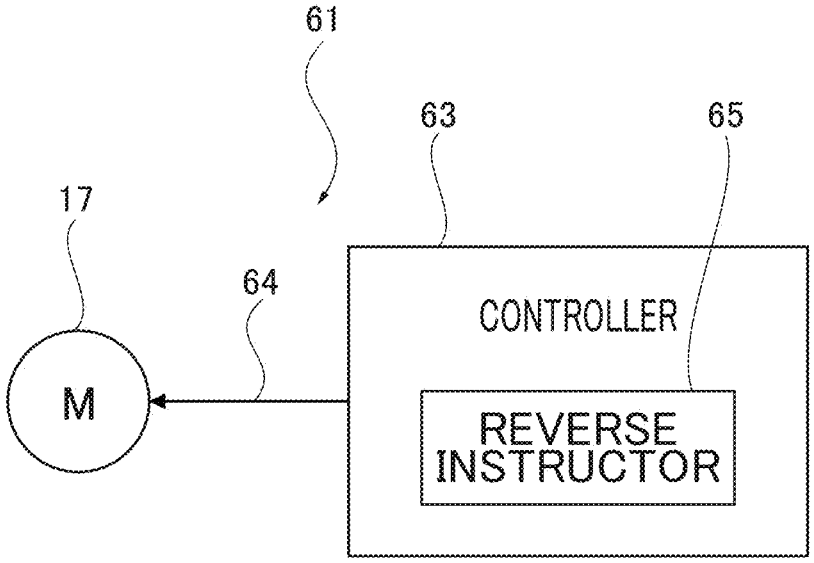
FIG. 11 is a block diagram of an example of the tension relief mechanism.

In the transfer routes 12-14, a feeding roller 16 (e.g., platen roller) is provided to feed the paper 2 pulled from the rolled paper 9 toward the ejection port 3. The paper feeding roller 16 is rotated by a driving device and a drive force transmission mechanism. As described later, the driving device includes a feeding motor 17 (shown in FIG. 11), and the drive force transmission mechanism includes one or more gears 18 (shown in FIG. 2).

In this embodiment, the feeding roller 16 is described as a platen roller having a paper feeding function. However, it is possible to use a platen roller not having a paper feeding function together with the feeding roller 16.

The feeding roller 16 is provided at a position relatively close to the ejection port 3 of the printer 1. In this embodiment, the feeding roller 16 has a relatively large diameter and is disposed right below the ejection port 3. The feeding roller 16 is positioned at the border between the middle transfer route 13 and the downstream transfer route 14, and transfers the paper 2 passed through the middle transfer route 13 to the ejection port 3 positioned upward through the downstream transfer route 14. Accordingly, the transfer direction of the paper 2 is changed from the horizontal direction to the vertical direction. In this embodiment, the feeding roller 16 is rotated clockwise to feed the paper 2 toward the ejection port 3 (forward feeding).

In the downstream transfer route 14, a thermal printer head 21 is disposed on the other side of the paper 2 with respect to the feeding roller 16. The thermal printer head 21 faces the feeding roller 16 and is pressed toward the feeding roller 16 to form a nip part for passing the paper 2 therethrough. In this embodiment, the thermal printer head 21 is provided in the printer body 5 so as to be pressed toward the feeding roller 16 (i.e. toward back side) by a non-illustrated spring, as indicated by an arrow 22.

In the downstream transfer route 14, a cutter for cutting the printed paper 2 to a predetermined length may be provided between the nip part and the ejection port 3. The cutter may be configured to automatically cut the paper 2 or may be configured to include, for example, a cutter blade such that the paper 2 is cut manually. In this embodiment, the cutter is configured as an automatic cutter unit 23. For example, a fixed blade is provided on the printer body 5 and a movable blade is provided on the cover 6. It should be noted, however, the positions of the fixed blade and the movable blade may be reversed on the printer body 5 and the cover 6.

The feeding roller 16, the movable blade of the cutter unit 23, and the like are attached to the cover 6. By opening the cover 6 upward and rearward, the feeding roller 16 and the like are lifted together with the cover 6 to expose the tray 11 and the transfer routes 12-14, thereby facilitating maintenance of the printer 1 and loading of the paper 2.

In addition to the above basic configuration, the printer 1 of the embodiment includes the following configuration.

As shown in FIG. 4, the printer 1 of the embodiment includes a reverse bending member 32 that bends the paper 2 drawn from the rolled paper 9 toward the opposite side to the curl of the paper 2. The reverse bending member 32 is disposed between a drawing position 31 at which the paper 2 is drawn from the rolled paper 9 and a position of the feeding roller 16 for feeding the paper 2 pulled from the rolled paper 9. The printer 1 further includes a bifurcated member 33 that collaborates with the reverse bending member 32 to correct the curl of the paper 2. The bifurcated member 33 is swingably arranged about a swing center shaft 34 (decurl shaft) extending in the width direction Y of the paper 2. The bifurcated member 33 includes an upstream arm 35 a tip part of which is positioned between the rolled paper 9 and the reverse bending member 32. The upstream arm 35 moves toward or from the reverse bending member 32. The bifurcated member 33 further includes a downstream arm 36, a tip part of which is positioned between the reverse bending member 32 and the feeding roller 16 so as to be in contact with the paper 2. The downstream arm 36 rotates depending on the tension level of the paper 2 so as to press the upstream arm 35 toward the reverse bending member 32.

The drawing position 31 of the paper 2 from the rolled paper 9 is determined such that the paper 2 is pulled upward and frontward from the lower part of the rolled paper 9. For example, the drawing position 31 of the paper 2 is a contact point of the rolled paper 9 through which a common tangent of the rolled paper 9 and the reverse bending member 32 passes. The drawing position 31 of the paper 2 shifts in accordance with the change in the outer diameter of the rolled paper 9.

In this embodiment, the upstream transfer route 12 is formed as a straight route connecting the drawing position 31 of the paper 2 and the reverse bending member 32. However, the upstream transfer route 12 is not limited to a straight route. For example, another member such as a roller and a shaft may be provided at a position shifted from the imaginary line connecting the drawing position 31 and the reverse bending member 32. With this, the transfer route 12 is curved by this additional member.

The curl of the rolled paper 9 is caused due to residual stress generated when the paper 2 is wound to form the rolled paper 9, and thus the paper 2 pulled out from the rolled paper 9 has an arcuate curled shape along the winding direction of the rolled paper 9. In this embodiment, the paper 2 pulled out from the rolled paper 9 is forcibly bent to the opposite side to the curl by the reverse bending member 32 in order to correct the curl. Here, "the opposite side to the curl" means that the paper 2 is bent inward in the radial direction of the rolled paper 9 based on the state of the rolled paper 9. Further, "forcibly bent to the opposite side to the curl" means that the transfer direction of the paper 2 in the upstream transfer route 12 is bent by the reverse bending member 32 to the opposite side to the curl, thereby oriented in the direction along the middle transfer route 13. To this end, the reverse bending member 32 is positioned at the border between the upstream transfer route 12 and the middle transfer route 13, and transfers the paper 2, which is upwardly pulled out from the rolled paper 9, to the front side toward the feeding roller 16. Accordingly, the transfer direction of the paper 2 is changed from the vertical direction to the horizontal direction. In this embodiment, the reverse bending member 32 changes the transfer direction of the paper 2 equal to or more than 90° (substantially 120°).

As long as it is possible to bend the paper 2 to the opposite side to the curl caused by the rolled paper 9, the configuration of the reverse bending member 32 is not limited to the above. In this embodiment, the reverse bending member 32 is an elongated rod-shaped member (stroking rod) which has a relatively small diameter and extends in the width direction Y of the paper 2. The reverse bending member 32 is made of a metal shaft having a uniform diameter in the longitudinal direction so as to have a desired rigidity. The reverse bending member 32 is disposed at a position higher than the drawing position 31 of the paper 2 and slightly in front of the drawing position 31. In this embodiment, the reverse bending member 32 has a diameter smaller than that of the feeding roller 16 and is disposed at a position as high as the lower portion of the feeding roller 16.

The reverse bending member 32 is positioned below the paper 2. The paper 2 is wound around the upper portion of the reverse bending member 32 in a mountain shape. The circumferential length over the winding range of the paper 2 with respect to the reverse bending member 32 corresponds to a contact length of the paper 2 with the reverse bending member 32. The central angle of the reverse bending member 32 over the winding range corresponds to a contact angle of the paper 2 with respect to the reverse bending member 32. The longer the contact length or/and the larger the contact angle, the better for the curl correction. The winding start point is at the most upstream point in the winding range, and the winding end point is at the most downstream point in the winding range. The lower the winding start point and the winding end point, the better for the curl correction. The winding start point of the paper 2 with respect to the reverse bending member 32 slightly changes in accordance with a displacement of the drawing position 31 due to the change in the diameter of the rolled paper 9.

The reverse bending member 32 and the bifurcated member 33 do not work independently but collaborate with each other to achieve a common function. Due to the collaboration between the reverse bending member 32 and the bifurcated member 33, the curl correction mechanism of this embodiment is realized.

Here, "curl correction" means to reduce the curl amount of the paper 2 or to eliminate the curl. In this embodiment, a great curl correction effect in which the paper 2 is substantially straightened and ejected from the ejection port 3 is achieved.

The bifurcated member 33 has a bifurcated portion when the printer 1 is viewed in the width direction Y. The bifurcated member 33 may be formed such that the entire member 33 has a bifurcated shape or a part of the member 33 is bifurcated. In this embodiment, most of the bifurcated member 33 is formed of a bifurcated portion. The bifurcated member 33 is disposed on the other side of the paper 2 with respect to the reverse bending member 32 (i.e., on upper side of paper 2). The bifurcated member 33 is positioned such that the reverse bending member 32 is located between the upstream arm 35 and the downstream arm 36 (i.e., inside bifurcated member 33). With this, the paper 2 passes between the bifurcated member 33 and the reverse bending member 32 in a substantially zigzag pattern.

Figure 5:
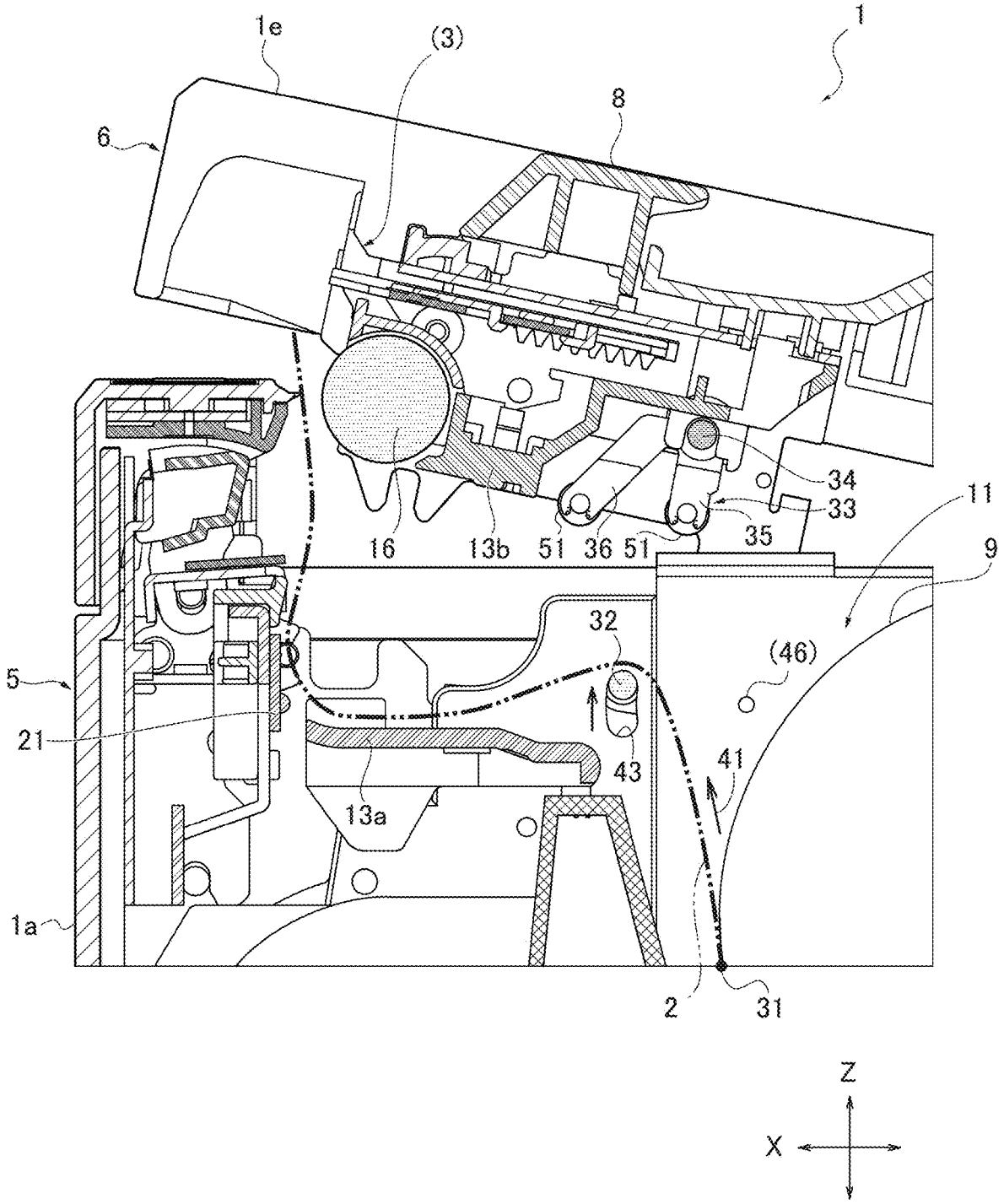
FIG. 5 is a view showing a state in which a cover of FIG. 4 is slightly open.

With reference to the line connecting the swing center shaft 34 and the reverse bending member 32, the upstream arm 35 of the bifurcated member 33 is positioned on the rolled paper 9 side (i.e., rear side of printer 1), whereas the downstream arm 36 of the same is positioned on the feeding roller 16 side (i.e., front side of printer 1). With this, when the bifurcated member 33 swings, the upstream arm 35 and the downstream arm 36 behave in the opposite ways with respect to the reverse bending member 32. That is, when the upstream arm 35 comes close to the reverse bending member 32, the downstream arm 36 moves away from the reverse bending member 32. When the downstream arm 36 comes close to the reverse bending member 32, the upstream arm 35 moves away from the reverse bending member 32. The bifurcated member 33 and the swing center shaft 34 are attached to the cover 6 (see FIG. 5).

The width direction Y of the paper 2 corresponds to the axial direction of the rolled paper 9, and thus the rolled paper 9 is loaded in the tray 11 of the printer 1 such that the axial direction of the rolled paper 9 coincides with the width direction Y of the printer 1.

The swing center shaft 34 is a shaft to be the center of the swing of the bifurcated member 33. The swing center shaft 34 is supported by the cover 6 at the portion where the bifurcated member 33 bifurcates (i.e., base portion) or at the portion therearound. The swing center shaft 34 is disposed at a position higher than the reverse bending member 32. In this embodiment, the swing center shaft 34 has a diameter smaller than that of the feeding roller 16 and is disposed at a position as high as the upper portion of the feeding roller 16.

Here, "swing" means a motion in which the bifurcated member 33 rotates to sway around the swing center shaft 34. "Swingable" means that the bifurcated member 33 is able to freely rotate clockwise and counterclockwise around the swing center shaft 34. The bifurcated member 33 does not have to rotate 360°. The tip part of the upstream arm 35 may abut on or move away from the reverse bending member 32 in accordance with the movement of the bifurcated member 33.

The upstream arm 35 is an arm positioned upstream in the transfer direction of the paper 2 with respect to the downstream arm 36. The tip part of the upstream arm 35 is disposed at a position close to the reverse bending member 32 (at substantially same position as reverse bending member 32) in the upstream transfer route 12 formed between the rolled paper 9 and the reverse bending member 32. As the tip part of the upstream arm 35 swings toward the reverse bending member 32, the tip part of the upstream arm 35 is pressed to the reverse bending member 32 with the paper 2 sandwiched therebetween and defines the winding start point of the paper 2 at the reverse bending member 32. In this embodiment, the winding start point of the paper 2 is, for example, at a lower position (a center or a lower position in vertical direction Z) on the rear side of the reverse bending member 32 in the front-back direction X.

With this, the tip part of the upstream arm 35 and the reverse bending member 32 hold and stroke almost the same position on both sides of the paper 2. It should be noted that the "tip part" herein also includes the portion around the tip end. In this embodiment, the upstream arm 35 substantially linearly extends downward from the swing center shaft 34 to the tip part. However, the shape of the upstream arm 35 is not limited to a linear shape.

The downstream arm 36 is an arm positioned downstream in the transfer direction of the paper 2 with respect to the upstream arm 35. The tip part of the downstream arm 36 is disposed at a position close to the reverse bending member 32 in the middle transfer route 13 formed between the reverse bending member 32 and the feeding roller 16. The tip part of the downstream arm 36 is in contact with the upper surface of the paper 2 while being separated from the reverse bending member 32. The downstream arm 36 bends the paper 2 to the opposite side to the curl made by the reverse bending member 32 (i.e., downward) by a predetermined amount in a state of which the tip part thereof is in contact with the paper 2.

To that end, the downstream arm 36 extends downward beyond a line connecting the reverse bending member 32 and the feeding roller 16 and has a length such that the tip part of the downstream arm 36 does not slightly reach the lower route forming member 13*a*. The tip part of the downstream arm 36 may be the tip end of the downstream arm 36 or the front portion of the downstream arm 36.

The downstream arm 36 is formed so as not to contact the reverse bending member 32, the feeding roller 16, the upper and lower route forming members 13*a*, 13*b*, and the like. Accordingly, a swing space for the downstream arm 36 is formed inside the printer 1. In this embodiment, the downstream arm 36 substantially linearly extends from the swing center shaft 34 to the tip part with a downward slope. However, the shape of the upstream arm 35 is not limited to a linear shape.

The direction of rotational displacement of the tip part of the downstream arm 36 caused by a change in the tension level of the paper 2 may be a tangent direction at the contact point with the paper 2 on the circle around the swing center shaft 34 through which the tip part of the downstream arm 36 passes. Alternatively, the direction of rotational displacement of the tip part of the downstream arm 36 may be a direction between the direction toward the downstream side substantially along the surface of the paper 2 and the direction perpendicular to the surface of the paper 2 when viewed from the side (in width direction Y of printer 1), and is the direction that intersects the surface of the paper 2. In this embodiment, the direction of rotational displacement of the tip part of the downstream arm 36 is a diagonally upward direction.

When the tension of the paper 2 increases, the surface position of the paper 2 moves upward. Accordingly, the downstream arm 36, which is in contact with the upper surface of the paper 2, is pushed upward by the movement of the paper 2, resulting in the downstream arm 36 rotating upward about the swing center shaft 34. When the tension of the paper 2 decreases or is released, the downstream arm 36 rotates in the opposite side (downward) by the amount of looseness of the paper 2.

The upstream arm 35 and the downstream arm 36 may be configured as an integral part or may be configured as separated parts and then assembled integrally. When the upstream arm 35 and the downstream arm 36 are configured as an integral part, the upstream arm 35 and the downstream arm 36 swing integrally.

When the upstream arm 35 and the downstream arm 36 are configured as separated parts and assembled integrally, it is possible to swing the upstream arm 35 and the downstream arm 36 integrally or separately. To form the bifurcated member 33 of this embodiment, it is preferable to swing the upstream arm 35 and the downstream arm 36 substantially integrally. However, as long as the desired curl correction effect is achieved, a slight amount of play may be provided between the upstream arm 35 and the downstream arm 36.

The swing center shaft 34 may be provided to be positioned on the other side of the feeding roller 16 with respect to the reverse bending member 32.

Here, the "other side of the feeding roller 16" means the swing center shaft 34 is positioned on the rear side in the front-back direction X of the printer 1 with respect to the reverse bending member 32. With this, the distance from the feeding roller 16 to the swing center shaft 34 in the front-back direction X of the printer 1 becomes longer than the distance from the feeding roller 16 to the reverse bending member 32 in the front-back direction X of the printer 1. Accordingly, the downstream arm 36 can have a long distance from the swing center shaft 34 to the contact point on the paper 2. In this embodiment, the distance from the swing center shaft 34 to the contact point of the downstream arm 36 on the paper 2 is longer than the distance from the swing center shaft 34 to the tip part of the upstream arm 35. The swing center shaft 34 is preferably located at an appropriate rear position on the rear side of the reverse bending member 32 but not too far behind the reverse bending member 32. For example, the swing center shaft 34 is provided at a position between the drawing position 31 of the paper 2 and the reverse bending member 32 in the front-back direction X of the printer 1.

Structurally, it is possible to provide the swing center shaft 34 on the side of the feeding roller 16 with respect to the reverse bending member 32 (i.e., closer to front side of printer 1 than reverse bending member 32). However, in such a configuration, the distance from the swing center shaft 34 to the contact point of the downstream arm 36 on the paper 2 becomes shorter than the distance from the swing center shaft 34 to the tip part of the upstream arm 35. Therefore, it is preferable to dispose the swing center shaft 34 at a position opposite to the feeding roller 16 with respect to the reverse bending member 32.

Figure 6:
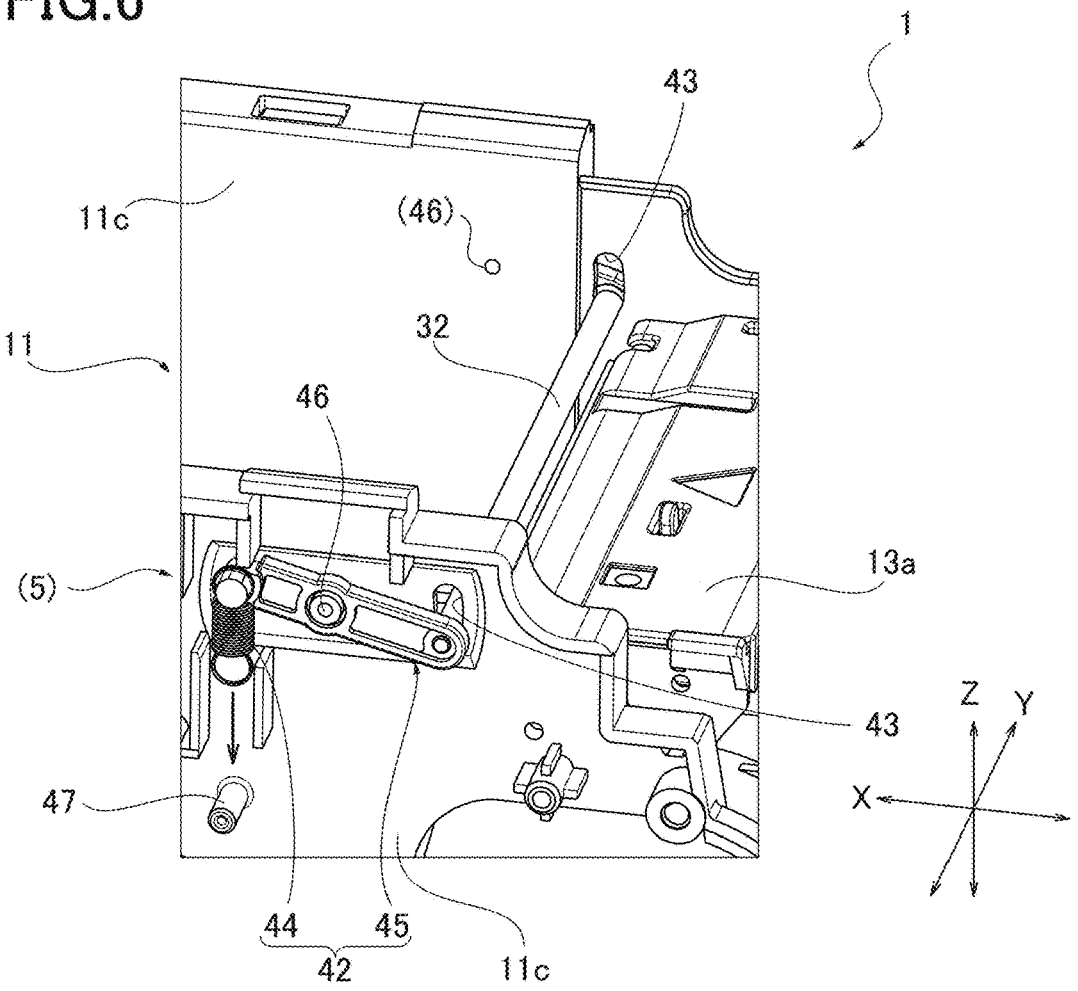
FIG. 6 is a partially enlarged perspective view showing a damper attached to the printer.
Figure 7:
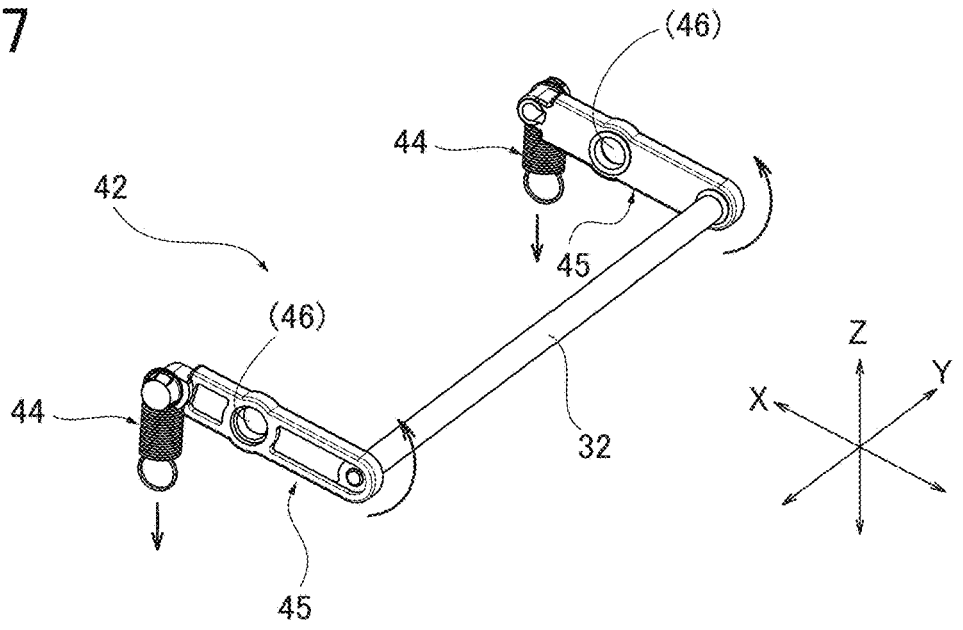
FIG. 7 is a partially enlarged perspective view showing a structure of the damper.

As shown in FIGS. 6 and 7, the reverse bending member 32 may be provided so as to be movable along the direction substantially orthogonal to the direction from the upstream arm 35 toward the downstream arm 36. The reverse bending member 32 may be supported so as to be elastically displaceable via a damper 42 which presses the reverse bending member 32 toward the opposite side to the drawing position 31.

The moving direction of the reverse bending member 32 with reference to the bifurcated member 33 may be a direction substantially orthogonal to the direction from the (tip part of) upstream arm 35 toward the (tip part of) downstream arm 36 (i.e., vertical direction Z). It should be noted that the "vertical direction" herein may include not only the exact vertical direction but also the substantially vertical direction such that the damper effect can be obtained without impairing the sufficient curl correction effect.

Alternatively, the moving direction of the reverse bending member 32 may be substantially in a drawing direction 41 (see FIG. 4) of the paper 2 from the rolled paper 9. The drawing direction 41 of the paper 2 corresponds to the transfer direction of the paper 2 in the upstream transfer route 12. Also, the drawing direction 41 of the paper 2 corresponds to the direction of the common tangent which connects the drawing position 31 of the paper 2 from the rolled paper 9 and the winding start point of the reverse bending member 32. In such a case, the reverse bending member 32 is supported so as to be freely movable in the drawing direction 41 or a direction approximated to the drawing direction 41 (substantially same as vertical direction Z). In this embodiment, the tray 11 for the rolled paper 9 has elongated slots 43 extending in the vertical direction Z on both sidewalls 11*c*, and the both end parts of the reverse bending member 32 are placed through the elongated slots 43. Accordingly, the reverse bending member 32 is configured to be movable along the elongated slots 43 in the vertical direction Z. That is, the moving direction of the reverse bending member 32 and the drawing direction 41 of the paper 2 are similar to each other.

The other side of the drawing position 31 corresponds to the side away from the drawing position 31. In other words, the other side of the drawing position 31 corresponds to the downstream side in the transfer direction of the paper 2 in the upstream transfer route 12. In this embodiment, the other side of the drawing position 31 is on the upper side of the printer 1.

The damper 42 is a shock absorber that is provided on the reverse bending member 32 in order to absorb the force acting on the reverse bending member 32 due to the paper 2. The damper 42 may not be provided in the printer 1, but it is preferable to provide the damper 42. The configuration of the damper 42 is not limited, but in this embodiment, the damper 42 includes a tension spring 44 and a damper arm 45.

Both ends of the reverse bending member 32 are protruded outside of both sidewalls 11*c* of the tray 11 from the elongated slots 43 and are supported by a pair of the damper arms 45 that are arranged in parallel. The pair of the damper arms 45 has substantially the identical shape and the identical length, and each of the damper arms 45 extends in the front-back direction along the outer surface of the corresponding sidewalls 11*c* of the tray 11 so as to be arranged in parallel.

Each of the pair of the damper arms 45 is rotatably supported, at the intermediate part thereof, by a rotation shaft 46 extending in the width direction Y of the printer 1. Both rotation shafts 46 are provided at the positions which are behind the elongated slots 43 on the sidewalls 11*c* of the tray 11 and are the same in the front-back direction X and the vertical direction Z. The reverse bending member 32 is attached to the front end of the pair of the damper arms 45. The tension spring 44 is attached to each rear end of the pair of the damper arms 45 in a state of being extended longer than the natural length of the tension spring 44.

The elongated slots 43 each have an arc shape centered on the rotation shaft 46. The reverse bending member 32 is pressed to the upper end of the elongated slots 43 by the tension springs 44. That is, when no load is applied to the reverse bending member 32, the reverse bending member 32 is positioned at the upper end of the elongated slots 43. When a load from the paper 2 is applied to the reverse bending member 32, the reverse bending member 32 is displaced downward along the elongated slots 43.

The upper ends of the tension springs 44 are respectively fixed to and held at the tip ends of the damper arms 45. The tension springs 44 are respectively fixed, at the lower ends thereof, to locking protruding parts 47 provided on lower positions (i.e., positions lower than tip ends of damper arms 45) on the sidewalls 11*c* of the tray 11 in a state of being extended. The spring force of the tension spring 44 is determined such that the damper effect is obtained without deteriorating the sufficient curl correction effects.

By displacing the reverse bending member 32 substantially in the vertical direction Z, the winding start point with respect to the reverse bending member 32 slightly changes. Accordingly, the contact point of the upstream arm 35 with the reverse bending member 32 is determined at an optimal position considering such a vertical displacement of the reverse bending member 32.

Figure 8:
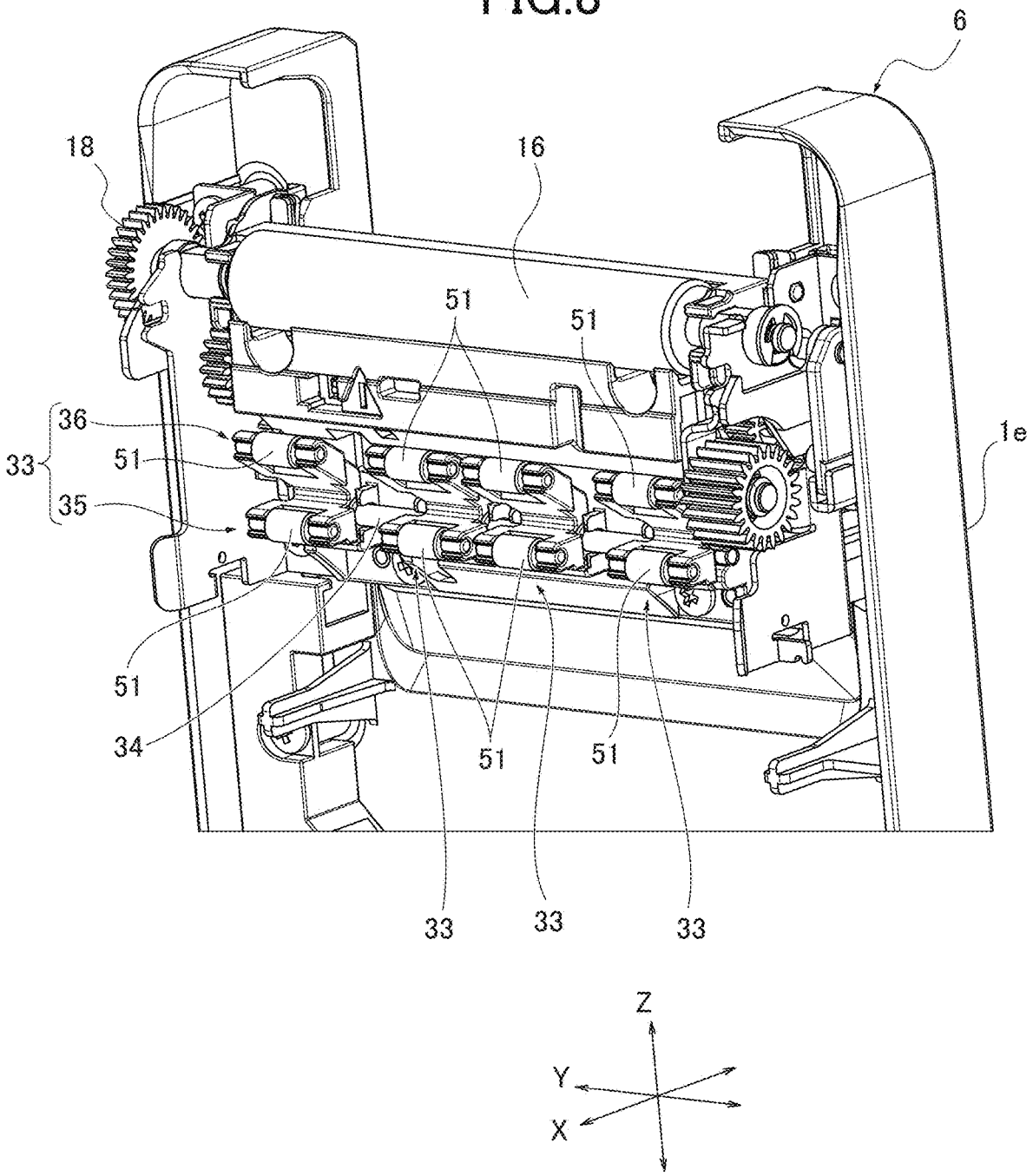
FIG. 8 is a perspective view of the back side of the cover viewed from the front side when the cover having a plurality of bifurcated members is open upward.
Figure 9:
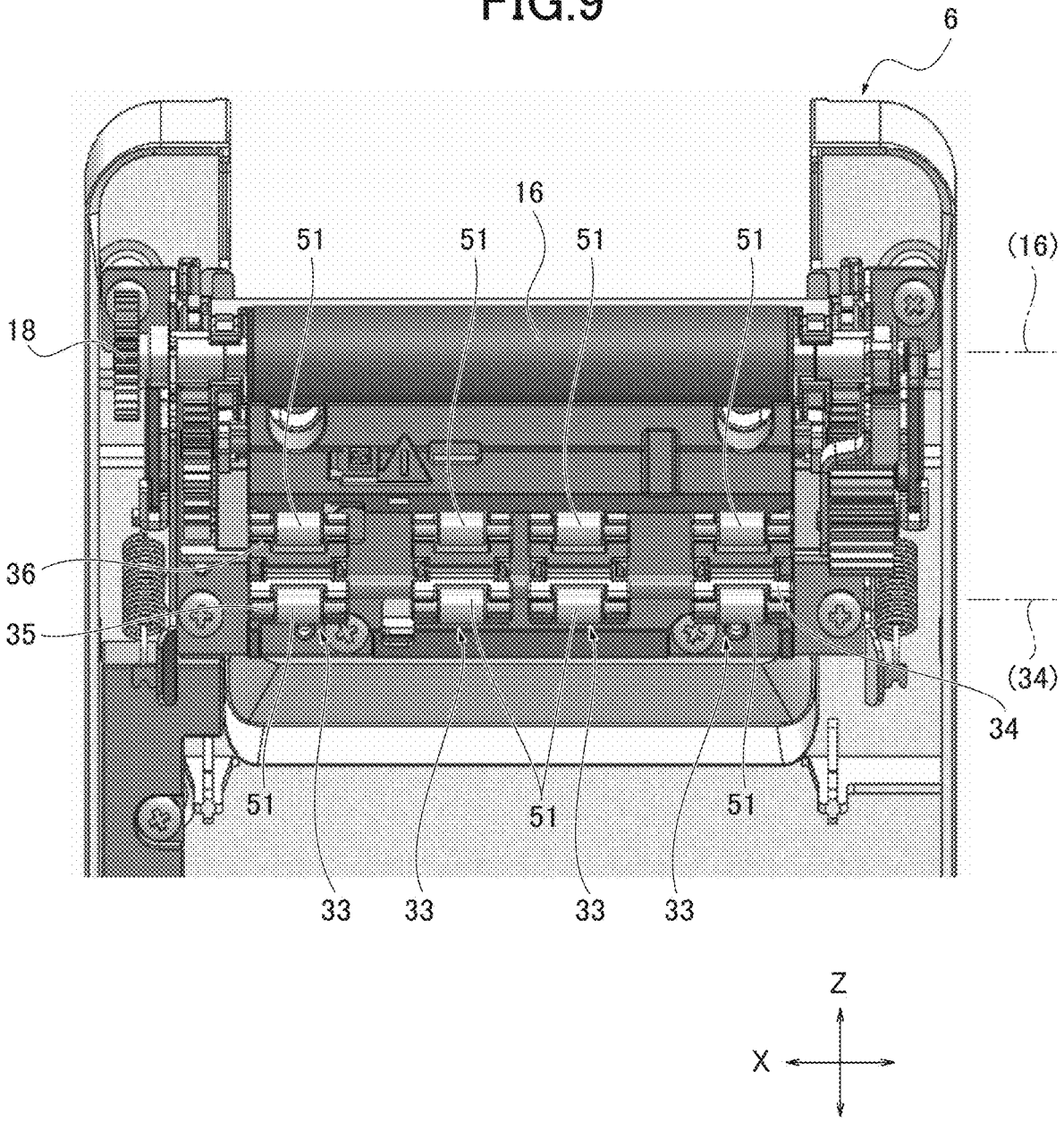
FIG. 9 is a view illustrating the back side of the cover viewed from the front side.
Figure 10A:
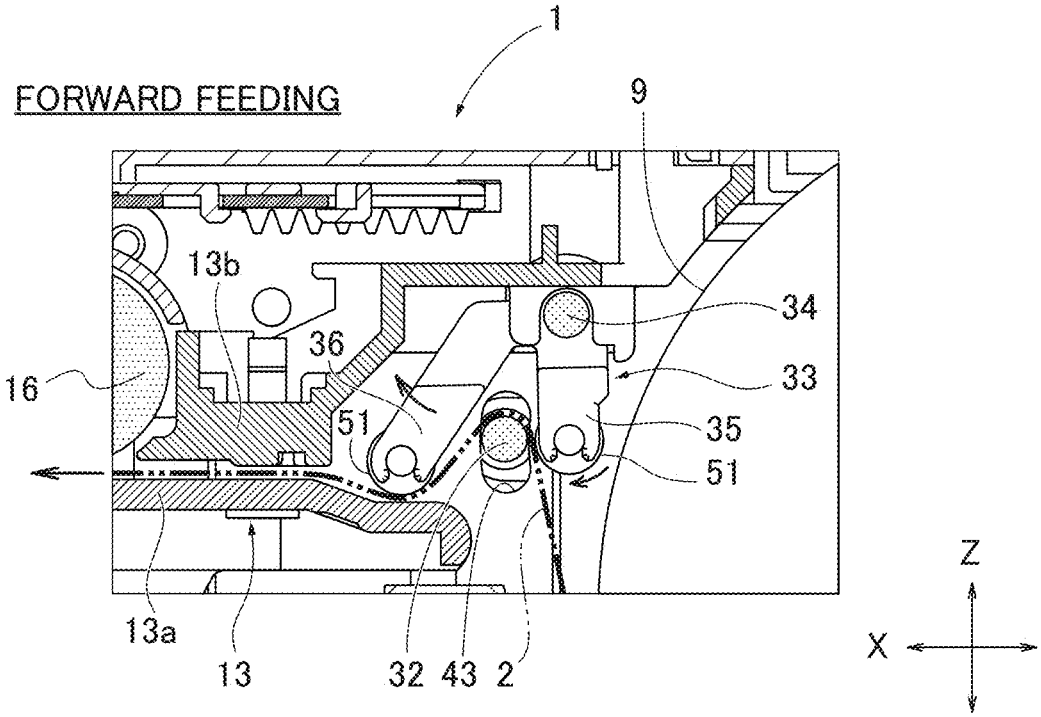
FIG. 10A is a view illustrating an operation of a tension relief mechanism when the paper is fed forward.
Figure 10B:
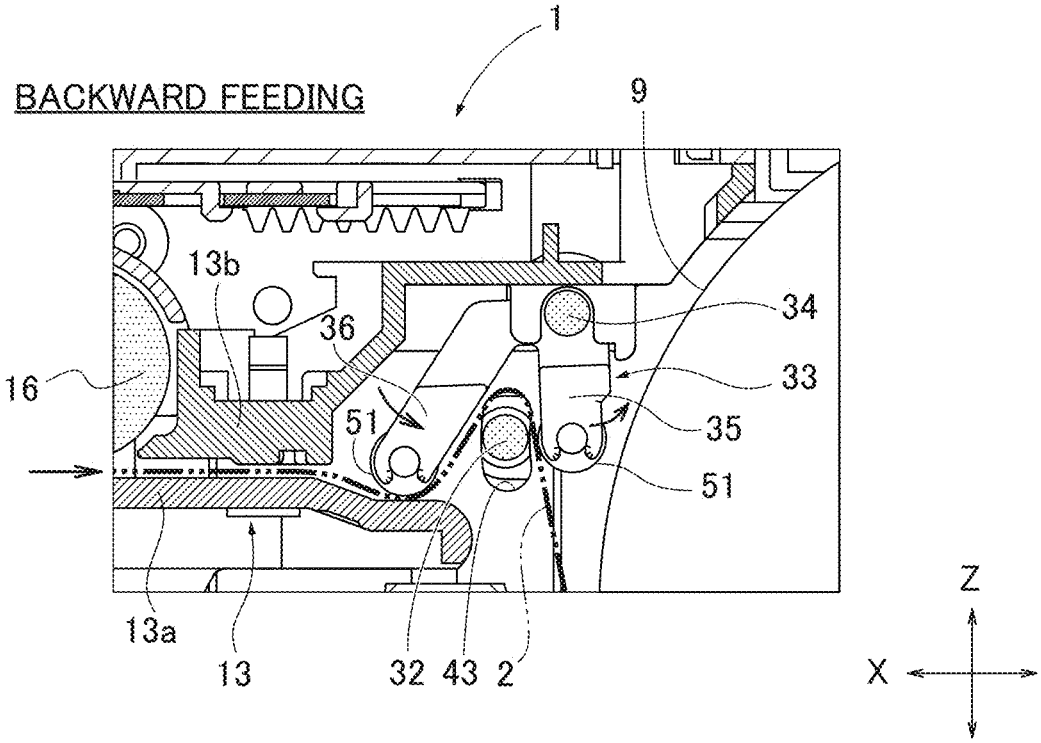
FIG. 10B is a view illustrating an operation of the tension relief mechanism when the paper is fed backward.

As shown in FIGS. 8 and 9, the printer 1 may include a plurality of bifurcated members 33 arranged in the width direction Y of the paper 2.

The printer 1 may include single or plural bifurcated member(s) 33. In this embodiment, the printer 1 includes two or more bifurcated members 33 arranged in the width direction Y of the paper 2.

When only a single bifurcated member 33 is provided, the bifurcated member 33 is, for example, configured to have a width substantially identical to the maximum width dimension of the paper 2 to be used and is disposed in accordance with the width range of the paper 2. When a plurality of bifurcated members 33 is provided, the bifurcated members 33 are, for example, configured to have a width shorter than the width dimension of the paper 2 in accordance with the number of the bifurcated members 33 and are arranged in the width range of the paper 2.

In such a case, the swing center shaft 34 may be provided for each of the plurality of bifurcated members 33. However, it is preferable to provide the single swing center shaft 34 having the length corresponding to the entire width range of the paper 2 so as to be shared by the plurality of the bifurcated members 33.

In this embodiment, the printer 1 includes four bifurcated members 33 arranged in the width direction Y of the paper 2. Specifically, two of the bifurcated members 33 are provided at positions on one side in the width direction Y so as to correspond to positions of the width ends of two kinds of paper 2 that are mostly used. The rest of the two bifurcated members are provided on the other side in the width direction Y so as to be symmetrical with the above two bifurcated members 33 on the one side. With this, it is possible to provide the plurality of bifurcated members 33 at the optimal and well-balanced positions for mostly used two kinds of papers 2.

As shown in FIGS. 8 and 9, at least one of the upstream arms 35 or the downstream arms 36 may include a roller 51 on a contact part with the paper 2.

The contact parts of the upstream arms 35 with the paper 2 correspond to the tip ends of the upstream arms 35. The contact parts of the downstream arms 36 with the paper 2 correspond to the tip ends of the downstream arms 36. The upstream arms 35 and/or the downstream arms 36 may be configured not to include the rollers 51 or may be configured to include the rollers 51.

When the rollers 51 are not included, the contact parts of the upstream arms 35 with the paper 2 and/or the contact parts of the downstream arms 36 with the paper 2 are preferably rounded to have a similar shape to the rollers 51 in order to make the contact parts with the paper 2 smoothly.

When the rollers 51 are included, the rollers 51 may be provided only on the upstream arms 35 or may be provided only on the downstream arms 36. Alternatively, the rollers 51 may be provided on both the upstream arms 35 and the downstream arms 36.

When a plurality of bifurcated members 33 is provided in the width direction Y of the paper 2, the same rollers 51 are attached to the upstream arms 35 and/or the downstream arms 36 arranged in parallel along the width direction Y. With this, all the bifurcated members 33 contact the paper 2 under the same condition.

The rollers 51 are supported at the tip ends of the upstream arms 35 and/or the tip ends of the downstream arms 36 so as to be rotatable around shafts extending in the width direction Y of the printer 1. The rollers 51 all have the same diameter. The shafts of the rollers 51 are provided so as to be aligned on the same line in the width direction Y.

In this embodiment, the rollers 51 are provided on all the contact parts of both of the upstream arms 35 and the downstream arms 36 of the plurality of the bifurcated members 33 arranged in the width direction Y of the printer 1. The diameters of the rollers 51 for the upstream arms 35 and the downstream arms 36 are slightly larger than the diameter of the reverse bending member 32. Further, the axial centers of the rollers 51 for the upstream arms 35 and the downstream arms 36 are disposed at a position approximately equal to or lower than the axial center of the reverse bending member 32.

A tension relief mechanism 61 (shown, for example, in FIG. 11) may be provided to the printer 1 in order to relax the tension of the paper 2 when the transportation of the paper 2 by the feeding roller 16 is stopped.

The tension relief mechanism 61 is configured such that at least the tension of the paper 2 around the reverse bending member 32, which is located at the border between the upstream transfer route 12 and the middle transfer route 13, is relaxed when the transportation of the paper 2 is stopped. The tension relief mechanism 61 may be omitted but is preferably provided. The tension relief mechanism 61 may be configured as an active type or as a passive type.

An example of an active tension relief mechanism 61 is a back-feed mechanism in which the paper 2 is slightly returned toward the rolled paper 9. As exemplarily shown in FIG. 11, such a back-feed mechanism (i.e., tension relief mechanism 61) may be configured to slightly reverse-rotate the feeding motor 17 when the transportation of the paper 2 is stopped. The back-feed mechanism includes a controller 63 to control the feeding motor 17, and the controller 63 is configured to include, for example, a reverse instructor 65 to output a motor reverse signal 64. For example, the reverse instructor 65 is configured to output the motor reverse signal 64 to slightly reverse rotate the feeding motor 17 when the paper transportation of the printer 1 has been stopped for a certain period of time or when the printer 1 is turned off.

An example of a passive tension relief mechanism 61 is realized by providing a small play in the rotation direction at the feeding roller 16 or at the gear 18 for transmitting the drive force to the feeding roller 16. Additionally, such a tension relief mechanism 61 may be configured as a semi-active mechanism in which a return spring or the like is inserted into the feeding roller 16 or the gear 18 having the play so as to slightly bias the feeding roller 16 in the reverse rotation direction.

Alternatively, the tension relief mechanism 61 may be configured, for example, by proving a small play in the swing direction at the bifurcated member 33 or between the upstream arm 35 and the downstream arm 36. Additionally, such a tension relief mechanism 61 may be configured as a semi-active mechanism in which a return spring or the like is inserted into the bifurcated member 33 or the space between the upstream arm 35 and the downstream arm 36 having the play so as to slightly bias the upstream arm 35 in the direction away from the reverse bending member 32.

With this, the tension of the paper 2 is naturally relaxed due to the play provided at, for example, the feeding roller 16 or the bifurcated member 33 when the driving force of the feeding roller 16 caused by the feeding motor 17 is released. Additionally, the tension of the paper 2 is further relaxed since the feeding roller 16 or the bifurcated member 33 is rotated by the play in the back-feed direction due to the return spring.

The operations of the embodiment will be described hereinafter.

In order to load the paper 2 into the printer 1, the cover 6 is opened upward to expose the tray 11 provided inside the printer body 5.

The rolled paper 9 is then loaded in the tray 11, and the end of the paper 2 pulled out from the rolled paper 9 is brought to the ejection port 3. The cover 6 is then closed such that the paper 2 is set along the transfer routes 12-14 in the printer 1.

As the rolled paper 9 is wound or rolled into a roll, it is unavoidable to be curled. If the paper 2 printed by the printer 1 using the rolled paper 9 is fed to the ejection port 3 as it is, the paper 2 ejected from the ejection port 3 is curled. It is, however, not desirable for a user to have the paper 2 curled.

With this embodiment, the following effects are obtained.

In this embodiment, the reverse bending member 32 is provided between the drawing position 31 of the paper 2 drawn from the rolled paper 9 and the feeding roller 16 so as to bend the paper 2 to the opposite side to the curl caused by the rolled paper 9. Additionally, the bifurcated member 33 is provided to associate with the reverse bending member 32 such that the curl of the paper 2 is corrected by the reverse bending member 32 and the bifurcated member 33.

The paper 2 pulled out from the rolled paper 9 passes through the upstream arm 35 of the bifurcated member 33, the reverse bending member 32, and the downstream arm 36 of the bifurcated member 33 in a zigzag pattern. The paper 2 is then set to the printer 1 while being in contact with the feeding roller 16. As the paper 2 is fed forward by rotating the feeding roller 16, the curl of the paper 2 is corrected by the reverse bending member 32 as well as the upstream arm 35 and the downstream arm 36 of the bifurcated member 33. Accordingly, it is possible to eject the paper 2 without a curl.

At the position between the reverse bending member 32 and the feeding roller 16 (in middle transfer route 13), the paper 2 is brought into a taut state due to the tension applied by the rotation of the feeding roller 16. Since the tip end of the downstream arm 36 of the bifurcated member 33 is in contact with the upper surface of the paper 2, the downstream arm 36 is pressed by the paper 2 and rotated about the swing center shaft 34 in a direction away from the paper 2 and the reverse bending member 32 (i.e., upper side and front side).

As the downstream arm 36 rotates in the direction away from the reverse bending member 32, the tip end of the upstream arm 35 positioned between the rolled paper 9 and the reverse bending member 32 (in upstream transfer route 12) moves in a direction approaching the reverse bending member 32. Accordingly, the tip end of the upstream arm 35 is pressed onto the reverse bending member 32. That is, the paper 2 is directly and simultaneously clipped from both sides at the same position by the reverse bending member 32 and the tip end of the upstream arm 35.

At this time, the contact part of the tip end of the downstream arm 36 with the paper 2 slightly moves in a direction away from the reverse bending member 32 (i.e., substantially upward) in accordance with the tension level of the paper 2. On the other hand, the tip end of the upstream arm 35 moves toward the reverse bending member 32. Therefore, the pressing force applied between the tip end of the upstream arm 35 and the reverse bending member 32 becomes sufficiently strong.

By clipping the paper 2 at the same position from both sides with the reverse bending member 32 and the tip end of the upstream arm 35, both sides of the paper 2 are rubbed strongly at the same time. Additionally, due to the clipping of the paper 2, the tension of the paper 2 between the reverse bending member 32 and the feeding roller 16 (in middle transfer route 13) increases. Due to the increase in the tension, the paper 2 is fed while being rubbed strongly and reversely bent strongly over the entire range along the surface of the reverse bending member 32. As a result, the curl of the paper 2 is effectively corrected. Accordingly, the curl correction mechanism comprising the reverse bending member 32 and the bifurcated member 33 achieves a strong curl correction effect with a simple structure. As the structure is simple, it is also possible to implement the curl correction mechanism at low cost.

The curl correction mechanism of this embodiment uses the tension level of the paper 2 to rotate the bifurcated member 33. That is, the curl correction mechanism of this embodiment does not use the tension itself applied between the reverse bending member 32 and the feeding roller 16 as a power source. With this, the tension of the paper 2 is more effectively used. To be specific, the downstream arm 36 is moved in a direction away from the surface of the paper 2 using the tension applied to the paper 2 in accordance with the tension level of the paper 2. Thus, even when the moving amount of the tip end of the downstream arm 36 is relatively small, it is possible to securely move the downstream arm 36 by a required amount (for pressing) so as to strongly press the tip end of the upstream arm 35 onto the reverse bending member 32. As a result, the stable curl correction effect is achieved.

Further, the curl correction mechanism of this embodiment is configured such that the tip end of the upstream arm 35 is pressed onto the reverse bending member 32 positioned downstream of the upstream arm 35. With this, it is possible to apply a larger reverse bending to the paper 2 by increasing the contact angle and/or the contact length of the reverse bending member 32 with the paper 2. Additionally, by increasing the contact angle and/or the contact length, the force applied to the reverse bending portion of the paper 2 on the reverse bending member 32 increases. Consequently, the paper 2 is rubbed by the reverse bending member 32 more strongly.

As described above, the curl correction mechanism of this embodiment is able to correct the curl of the paper 2 with a simple structure reliably and effectively, thereby achieving the stable curl correction effect. Additionally, it is possible to further improve the function as the curl correction mechanism by effectively utilize the upstream arm 35.

Since the curl correction mechanism of this embodiment has a simple structure, it is possible to reduce the influence of variations in component accuracy on the curl correction effect. This means the requirement for the component accuracy lowers. Therefore, it is possible to manufacture the bifurcated member 33, the reverse bending member 32, and the like with play.

Additionally, the tension of the paper 2 between the reverse bending member 32 and the feeding roller 16 (in middle transfer route) is increased due to the clipping of the paper 2 by the reverse bending member 32 and the tip end of the upstream arm 35. Accordingly, it is possible to suppress the fluttering of the paper 2 between the reverse bending member 32 and the feeding roller 16 so as to feed the paper 2 in a more stable state at a higher speed. Also, it is possible to suppress a decrease in the tension of the paper 2 between the reverse bending member 32 and the feeding roller even when the weight of the rolled paper 9 decreases as the diameter of the rolled paper 9 is reduced.

The swing center shaft 34 may be disposed on the other side of the feeding roller 16 with respect to the reverse bending member 32. In this case, the swing center shaft 34 is positioned on the rear side of the printer 1 (i.e., close to rolled paper 9), and the distance from the swing center shaft 34 to the tip end of the downstream arm 36 becomes longer than the distance from the swing center shaft 34 to the tip end of the upstream arm 35. With this, the pressing force of the upstream arm 35 applied to the reverse bending member 32 in response to the rotation of the downstream arm 36 becomes strong. Consequently, it is possible to obtain a strong curl correction effect between the tip end of the upstream arm 35 and the reverse bending member 32.

The reverse bending member 32 may be provided so as to be movable along the direction substantially orthogonal to the direction from the upstream arm 35 toward the downstream arm 36 (i.e., substantially vertical direction Z or drawing direction 41 of paper 2 from rolled paper 9). The reverse bending member 32 may be supported so as to be elastically displaceable via the damper 42 which presses the reverse bending member 32 toward the side opposite to the drawing position 31 (i.e., downstream and upward side of transfer route 12).

That is, when the paper 2 pulled out from the rolled paper 9 is hung on the reverse bending member 32 and the paper 2 is fed, the reverse bending member 32 can elastically move substantially in the vertical direction Z or substantially in the drawing direction 41 due to the damper 42. In this embodiment, when the paper 2 is pulled strongly or quickly, the reverse bending member 32 greatly sinks downward in the vertical direction Z (i.e., toward drawing position 31). When the paper 2 is pulled weakly or slowly, the reverse bending member 32 slightly sinks downward in the vertical direction Z (i.e., toward drawing position 31). Due to this elastic displacement of the reverse bending member 32, the influence of fluctuations in tension acting on the paper 2 between the rolled paper 9 and the reverse bending member 32 (in upstream transfer route 12) is mitigated. Accordingly, it is possible to pull the paper 2 reliably. This ensures, for example, stable print quality in various usage conditions.

The downward displacement amount of the reverse bending member 32 also differs due to the weight (or remaining amount) of the rolled paper 9. When the rolled paper 9 has a large diameter and is heavy, the reverse bending member 32 is largely displaced downward. Accordingly, the transport resistance of the paper 2 between the reverse bending member 32 and the bifurcated member 33 decreases. However, as the diameter of the rolled paper 9 decreases and the weight of the rolled paper 9 decreases, the downward displacement of the reverse bending member 32 decreases. Accordingly, the transportation resistance of the paper 2 between the reverse bending member 32 and the bifurcated member 33 increases. That is, when the weight of the rolled paper 9 decreases, the position of the reverse bending member 32 changes, thereby maintaining the tension of the paper 2. Accordingly, it is possible to stably pull out the paper 2 to the end even when the remaining amount of the rolled paper 9 changes.

The curl amount of the paper 2 is smaller as the curvature radius of the paper 2 positioned on the outer peripheral surface of the rolled paper 9 increases. On the other hand, the curl amount of the paper 2 is larger as the curvature radius of the paper 2 positioned on the outer peripheral surface of the rolled paper 9 decreases.

As described above, when the rolled paper 9 has a large diameter, the reverse bending member 32 is largely displaced downward, and the position of the rolled paper 9 becomes higher (i.e., downward displace amount becomes smaller) as the diameter of the rolled paper 9 becomes smaller.

When the position of the reverse bending member 32 is low (i.e., when the diameter of the rolled paper 9 is large and the curl amount is small), the contact point at which the tip end of the upstream arm 35 presses the reverse bending member 32 moves downward (i.e., the contact point is below the upstream arm 35 and above the reverse bending member 32). As a result, the contact angle and/or the contact length of the paper 2 with respect to the reverse bending member 32 becomes small, resulting in weakening the curl correction effect. When the position of the reverse bending member 32 is high (i.e., when the diameter of the rolled paper 9 is small and the curl amount is large), the contact point at which the tip end of the upstream arm 35 presses the reverse bending member 32 moves upward (i.e., the contact point is above the upstream arm 35 and below the reverse bending member 32). As a result, the contact angle and/or the contact length of the paper 2 with respect to the reverse bending member 32 becomes large, resulting in strengthening the curl correction effect.

Therefore, the curl correction effect naturally changes in response to the curl amount of the paper 2. To be specific, the curl correction effect is adjusted such that the curl correction effect becomes small when the curl amount is small whereas the curl correction effect becomes strong when the curl amount is large. As a result, it is possible to perform the curl correction of the paper 2 so as to obtain the optimum effect at any time.

As described above, the reverse bending member 32 of this embodiment simultaneously realizes the optimum damper function and the function of adjusting the curl correction effect in response to the curl amount.

The printer 1 may include a plurality of the bifurcated members 33 arranged in the width direction Y of the paper 2. As the plurality of the bifurcated members 33 independently works, it is possible to correct the curl of the paper 2 evenly on the left and right even if the feeding roller 16 and the swing center shaft 34 (decurl shaft) are not sufficiently aligned in parallel. Therefore, it is possible to alleviate a problem such as a difference in the degree of the curl correction between the left and right sides of the paper 2. For example, it is also possible to prevent the occurrence of a phenomenon such as skewing of the paper 2 due to the difference in the curl correction effect on the left and right. Since it is possible to correct the curl of the paper 2 evenly over the entire range in the width direction Y of the paper 2, the influence of the variation in component accuracy on the curl correction effect can be reduced. This means the requirement for the component accuracy lowers. Therefore, it is possible to manufacture the bifurcated member 33, the reverse bending member 32, and the like with play.

At least one of the upstream arms 35 or the downstream arms 36 may include the roller 51 on the contact part with the paper 2. With this, the roller 51 provided at the contact part with the upstream arm 35 or/and the downstream arm 36 is rubbed by the paper 2 and rotates as the paper 2 is transferred or conveyed. Accordingly, the transfer resistance of the paper 2 at the contact part is appropriately reduced. This enables to reduce the driving force of the feeding roller 16 and to reduce the size of the driving device (feeding motor 17) for driving the feeding roller 16. Further, it is possible to prevent step-out of the drive device.

As the paper 2 loaded in the printer 1 is bent by the reverse bending member 32, the reverse bending member 32 may cause a bending mark on the paper 2 if the paper 2 is left in the printer 1 for a long time. In order to prevent such an issue, the tension relief mechanism 61 may be provided to the printer 1 so as to relax the tension of the paper 2 when the transportation of the paper 2 by the feeding roller 16 is stopped. With this, the paper 2 is slightly slackened by relaxing or releasing the tension of the paper 2 using the tension relief mechanism 61 when the transportation of the paper 2 by the feeding roller 16 is stopped. As a result, the contact pressure of the paper 2 against the reverse bending member 32 is weakened, and the paper 2 is separated from the reverse bending member 32 such that the bending state of the paper 2 caused by the reverse bending member 32 is loosened. Therefore, it is possible to prevent the paper 2 from having a bending mark due to the reverse bending member 32 even if the paper 2 is left in the printer 1 for a long time.

Although the present disclosure has been described in terms of an exemplary embodiment, it should not be limited thereto. It should be appreciated that variations or modifications may be made in the embodiment described by persons skilled in the art without departing from the scope of the present invention as defined by the following claims.

What is claimed is:

1. A printer comprising:

a feed roller that feeds paper drawn from a rolled paper along a paper path;

a reverse bending member that bends the paper drawn from the rolled paper toward an opposite side to a curl of the paper; and a bifurcated member that collaborates with the reverse bending member to correct the curl of the paper, wherein the reverse bending member is disposed along the paper path between an upstream drawing position at which the paper is drawn from the rolled paper and a downstream position of the feeding roller, wherein the bifurcated member is swingably arranged about a swing center shaft extending in a width direction of the paper, and the bifurcated member comprises:

an upstream arm, a tip of which is positioned upstream along the paper path relative to the reverse bending member and downstream along the paper path relative to the drawing position, the upstream arm moveable toward and away from the reverse bending member; and a downstream arm, a tip of which is positioned downstream along the paper path relative to the reverse bending member and upstream along the paper path relative to the feeding roller, and wherein the tip of the downstream arm is in contact with the paper, and the downstream arm and the upstream arm are connected and rotate in connection with one another so that the downstream arm swings about the swing center shaft in accordance with a tension level of the paper contacted against the tip of the downstream arm and so that the connected upstream arm presses the tip of the upstream arm toward the reverse bending member.

2. The printer according to claim 1, wherein the swing center shaft is positioned on an other side of the feeding roller with respect to the reverse bending member.

3. The printer according to claim 1, wherein the reverse bending member is separately movable from the upstream and downstream arms of the bifurcated member along a direction substantially orthogonal to a direction from the upstream arm toward the downstream arm, and the reverse bending member is supported to be elastically displaceable via a damper that presses the reverse bending member away from the drawing position.

4. The printer according to claim 1, further comprises a plurality of bifurcated members arranged in the width direction of the paper.

5. The printer according to claim 1, wherein at least one of the upstream arm or the downstream arm comprises a roller on a contact part thereof with the paper.

6. The printer according to claim 1, further comprises a tension relief mechanism that is configured to relax a tension of the paper when a transportation of the paper by the feeding roller is stopped.

* * * * *